US009152092B2

(12) United States Patent
Suzuki et al.

(10) Patent No.: US 9,152,092 B2
(45) Date of Patent: Oct. 6, 2015

(54) IMAGE FORMING APPARATUS

(71) Applicant: CANON KABUSHIKI KAISHA, Tokyo (JP)

(72) Inventors: Kazushi Suzuki, Suntou-gun (JP); Hiroshi Kawamura, Suntou-gun (JP); Kei Sawanaka, Susono (JP); Yoshimi Suzuki, Numazu (JP); Chikara Imaizumi, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 47 days.

(21) Appl. No.: 13/692,724

(22) Filed: Dec. 3, 2012

(65) Prior Publication Data

US 2013/0094880 A1 Apr. 18, 2013

Related U.S. Application Data

(63) Continuation of application No. PCT/JP2012/065473, filed on Jun. 18, 2012.

(30) Foreign Application Priority Data

Jun. 20, 2011 (JP) ..... 2011-136677
Jun. 15, 2012 (JP) ..... 2012-135975

(51) Int. Cl.

| | |
|---|---|
| ***G03G 15/16*** | (2006.01) |
| ***G03G 21/12*** | (2006.01) |
| ***G03G 15/01*** | (2006.01) |
| ***G03G 21/16*** | (2006.01) |

(52) U.S. Cl.

CPC ..... *G03G 15/161* (2013.01); *G03G 15/0189* (2013.01); *G03G 21/12* (2013.01); *G03G 21/1633* (2013.01); *G03G 2215/0132* (2013.01)

(58) Field of Classification Search

CPC ..... G03G 15/161
USPC ..... 399/35, 101, 125, 302, 308, 358, 360
See application file for complete search history.

(56) References Cited

U.S. PATENT DOCUMENTS 6,463,236 B2 * 10/2002 Morikami et al. ..... 399/121
8,254,823 B2 * 8/2012 Nagashima et al. ..... 399/360

FOREIGN PATENT DOCUMENTS

| | | | |
|---|---|---|---|
| JP | 2-5774 | U | 1/1990 |
| JP | 3-73986 | A | 3/1991 |
| JP | 11-038850 | A | 2/1999 |
| JP | 2002-196644 | A | 7/2002 |
| JP | 2004-029057 | A | 1/2004 |
| JP | 2004-061725 | A | 2/2004 |
| JP | 2006-065344 | A | 3/2006 |

(Continued)

*Primary Examiner* — Hoang Ngo
(74) *Attorney, Agent, or Firm* — Canon USA, Inc., IP Division

(57) ABSTRACT

A container is detachably mountable on an apparatus body in a mounting-detaching direction that is along the same direction as a mounting-detaching direction of a transfer unit and that is in the reverse direction of the mounting-detaching direction of the transfer unit. When the transfer unit and the container are mounted on the apparatus body, a belt, a cleaning device, and the container are arranged in that order in a transport direction of the belt. A discharge portion is provided, the discharge portion extending in the mounting-detaching direction of the container, for discharging the toner removed by the cleaning device to the container.

23 Claims, 16 Drawing Sheets

(56) References Cited

FOREIGN PATENT DOCUMENTS

| | | | |
|---|---|---|---|
| JP | 2006-259175 | A | 9/2006 |
| JP | 2007-133022 | A | 5/2007 |
| JP | 2007-219423 | A | 8/2007 |
| JP | 2009-134040 | A | 6/2009 |
| JP | 2009-145623 | A | 7/2009 |

* cited by examiner

IMAGE FORMING APPARATUS

CROSS-REFERENCE TO RELATED APPLICATIONS

This application is a Continuation of International Patent Application No. PCT/JP2012/065473, filed Jun. 18, 2012, which claims the benefit of Japanese Patent Application No. 2011-136677, filed Jun. 20, 2011 and No. 2012-135975 filed Jun. 15, 2012, all of which are hereby incorporated by reference herein in their entirety.

TECHNICAL FIELD

The present invention relates to an image forming apparatus that performs image formation by an electrophotographic method, such as a copier, a printer, a facsimile apparatus, or a multifunction device.

BACKGROUND ART

An in-line image forming apparatus that includes a plurality of photosensitive drums of respective colors arranged in line and forms a color image by successively superposing toner images of the respective colors on photosensitive drums onto each other is put into practical use, as an image forming apparatus of a plurality of colors or full colors using an electrophotographic method.

PTL 1 suggests a configuration in which a plurality of photosensitive drums are arranged below an intermediate transfer member and a first transfer surface of the intermediate transfer member is arranged in an inclined manner to decrease the distance of the intermediate transfer member from a first transfer portion to a second transfer portion and hence to decrease a period of time until a transfer material is output from an image forming apparatus. Also, since the intermediate transfer member is arranged in an inclined manner, the dimensions in the lateral direction and height direction of the image forming apparatus are decreased in a balanced manner and hence the space in the image forming apparatus is efficiently used.

A residual toner that is not second-transferred from the intermediate transfer member to a transfer material and remains on the intermediate transfer member is removed from the intermediate transfer member by a cleaning device. A conventionally known cleaning device is a configuration that scrapes the toner on the intermediate transfer member by a cleaning blade serving as a cleaning member that is pressed to the intermediate transfer member. The scraped toner is removed into a container that is provided in the image forming apparatus.

PTL 2 discloses a configuration in which an intermediate transfer member is integrally formed with a cleaning device as a transfer unit and the transfer unit is detachably mountable on an apparatus body. Further, PTL 3 discloses a configuration in which a container is attachable to and detachable from a cleaning device and the container is individually detachably mountable on an image forming apparatus.

CITATION LIST

Patent Literature

PTL 1 Japanese Patent Laid-Open No. 2004-029057
PTL 2 Japanese Patent Laid-Open No. 2009-145623
PTL 3 Japanese Patent Laid-Open No. 2002-196644

For easy replacement of the container, the container is desirably arranged at a front surface or one of side surfaces of the image forming apparatus. However, if a large capacity is secured at the front surface of the image forming apparatus, the space occupied by the container is increased and thus the size of the image forming apparatus is increased. Also, if a space with a sufficient capacity cannot be secured near the cleaning device, the container has to be arranged at a position with an excessive space in the image forming apparatus, and a toner conveying path has to be provided from the cleaning device to the container for the conveyance of the toner.

However, if the distance to the container is large, an additional part is required for the countermeasure for clogging of a toner in the conveying path and for leakage of a toner from a pass portion between conveying paths. Hence, the distance between the cleaning device and the container is desirably as small as possible.

Also, if the transfer unit including the cleaning device is detachably mountable on the apparatus body like the configuration described in PTL 2, when the transfer unit is mounted and detached, the cleaning device of the transfer unit has to be disconnected from the container. If the disconnection of the cleaning device of the transfer unit from the container is a complicated work, a toner may leak from a connection portion when the cleaning device is disconnected from the container.

The present invention is made in view of the above-described problems of related art, and the present invention provides an image forming apparatus that promotes a decrease in size of the apparatus by arranging a cleaning device closely to a container, that allows the container to be easily mounted on and detached from a transfer unit, and that prevents a toner from leaking from a connection portion.

SUMMARY OF INVENTION

To address the above-described problems, according to the invention of the subject application, an image forming apparatus includes an image bearing member that bears a toner image; a transfer unit including a belt that transports the toner image on the image bearing member, and a cleaning device that removes a toner adhering to the belt, the transfer unit being detachably mountable on an apparatus body in a transport direction of the belt; and a container that houses the toner removed by the cleaning device. The container is detachably mountable on the apparatus body in a mounting-detaching direction that is along the same direction as a mounting-detaching direction of the transfer unit and that is in the reverse direction of the mounting-detaching direction of the transfer unit. When the transfer unit and the container are mounted on the apparatus body, the belt, the cleaning device, and the container are arranged in that order in the transport direction of the belt. A discharge portion is provided, the discharge portion extending in the mounting-detaching direction of the container, for discharging the toner removed by the cleaning device to the container.

Further features of the present invention will become apparent from the following description of exemplary embodiments with reference to the attached drawings.

DESCRIPTION OF EMBODIMENTS

Preferable embodiments of the present invention are exemplarily described below in detail with reference to the drawings. It is to be noted that the dimensions, materials, shapes, and relative arrangements of components described in the following embodiments should be properly changed depending on configurations of an apparatus to which the present invention is applied and various conditions. Hence, unless otherwise particularly noted, it is not intended to limit the scope of the present invention to the embodiments.

First Embodiment

Figure 1:
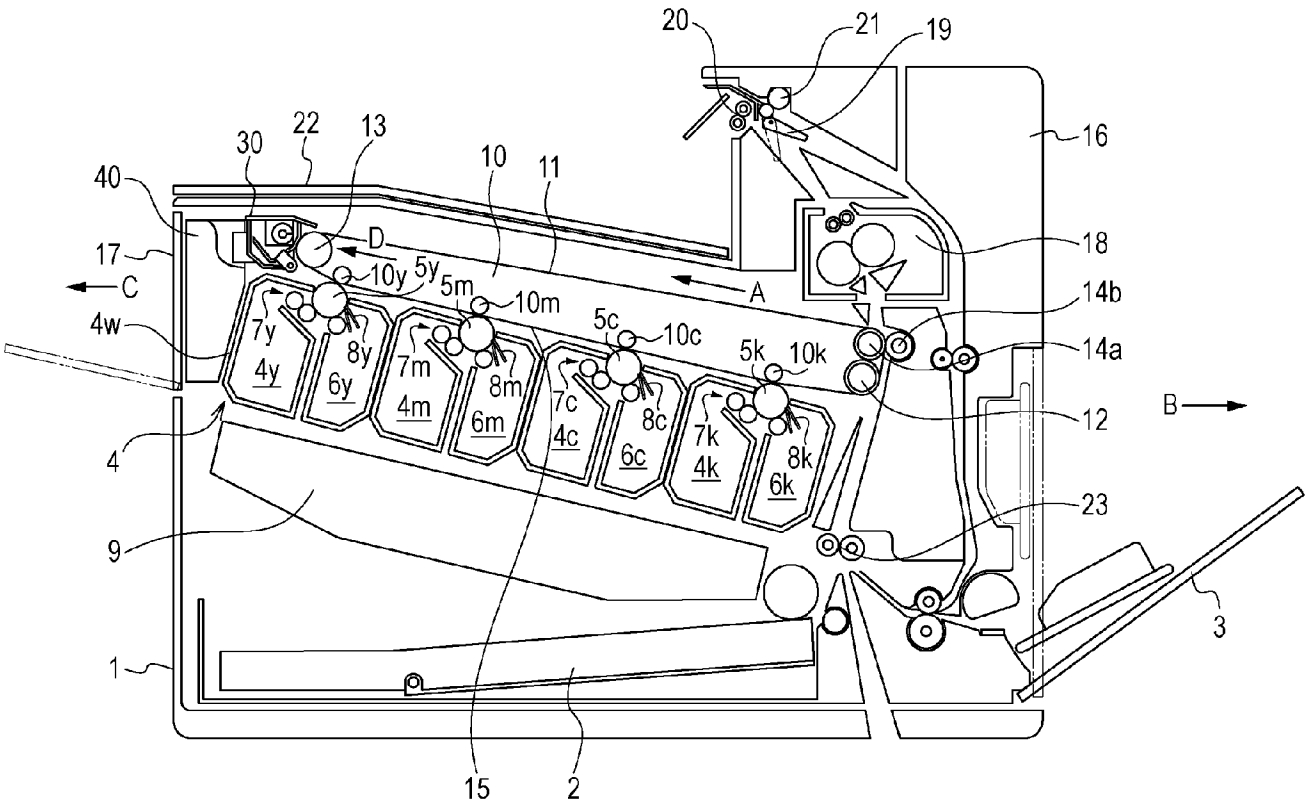
FIG. 1 is a cross-sectional view of an image forming apparatus according to a first embodiment.

A first embodiment of the present invention is described by using a color-image forming apparatus by an electrophotographic method with four drums. FIG. 1 is a cross-sectional view showing a general configuration of a full-color laser beam printer 1 (hereinafter, printer 1).

A cassette 2 is housed in a lower portion of the printer 1 so that the cassette 2 can be pulled out. A manual feed portion 3 is arranged at the right side in FIG. 1. Transfer materials are stacked on and housed in the cassette 2 and the manual feed portion 3. The transfer materials are separated one by one and fed. The printer 1 includes process cartridges 4*y*, 4*m*, 4*c*, and 4*k* (a process cartridge 4) corresponding to respective colors of yellow, magenta, cyan, and black. The process cartridges 4*y*, 4*m*, 4*c*, and 4*k* serve as a plurality of image forming units arranged in line. Photosensitive drums 5*y*, 5*m*, 5*c*, and 5*k* serving as image bearing members, and charging members 6*y*, 6*m*, 6*c*, and 6*k* that cause the surfaces of the photosensitive drums 5 to be uniformly electrically charged are arranged in the process cartridge 4. Development rollers 7*y*, 7*m*, 7*c*, and 7*k* that develop electrostatic latent images into toner images, and photosensitive-member cleaning blades 8*y*, 8*m*, 8*c*, and 8*k* (photosensitive-member cleaning blades 8) that remove residual toners remaining on the photosensitive drums 5 are arranged in the process cartridge 4. The development rollers 7 can come into contact with and can be separated from the photosensitive drums 5. Since the contact and separation of the development rollers 7 are performed in accordance with the electrostatic latent images, the life of the development rollers 7 is increased. The process cartridges 4*y*, 4*m*, 4*c*, and 4*k* (the process cartridge 4) are detachably mountable on the image forming apparatus. The image forming units are described as the process cartridge in which members relating to image formation can be collectively detachably mountable on the apparatus body. However, the image forming units may be individually mounted and detached.

A scanner unit 9 (charging means) that forms the electrostatic latent images on the photosensitive drums 5 by irradiating the photosensitive drums 5 with laser beams in accordance with image information is provided below the process cartridge 4. Further, a transfer unit is provided above the process cartridge 4.

The transfer unit according to this embodiment is an intermediate transfer unit 10 including first transfer rollers 10*y*, 10*m*, 10*c*, and 10*k*, an intermediate transfer belt 11, a driving roller 12, a tension roller 13, and a second transfer facing roller 14*a*. The intermediate transfer belt 11 is an endless belt for transferring the toner images on the photosensitive drums 5 onto a transfer material. The intermediate transfer belt 11 is wound around and supported by the driving roller 12, the tension roller 13, and the second transfer facing roller 14*a*. The tension roller 13 is urged by urging means (not shown) in a D direction indicated by an arrow shown in FIG. 1 and applies a predetermined tension to the intermediate transfer belt 11. When the driving roller 12 is rotationally driven by a motor (not shown) or the like, the intermediate transfer belt 11 rotates at a predetermined speed in an A direction indicated by an arrow in FIG. 1.

Further, the intermediate transfer unit 10 according to this embodiment includes a cleaning device 30 for removing a toner adhering to the intermediate transfer belt 11. The cleaning device 30 is arranged upstream of a first transfer portion in a rotation direction of the intermediate transfer belt 11 (the A direction indicated by the arrow in FIG. 1). The first transfer portion is formed by the photosensitive drum 5*y* and the first transfer roller 10*y*. Further, the cleaning device 30 is arranged downstream of a second transfer portion that is formed by the second transfer facing roller 14*a* and a second transfer roller 14*b* that is a second transfer member. Since the cleaning device 30 is provided to face the tension roller 13, the cleaning device 30 is arranged so as to be accommodated within the height of the intermediate transfer unit 10.

For decrease in size of the apparatus, the intermediate transfer unit 10 has a first transfer surface 15 that is formed at a side facing to the photosensitive drums 5 and is arranged at an inclination. The first transfer surface 15 of the intermediate transfer unit 10 is arranged in an inclined manner such that a portion near the cleaning device 30 is arranged at an upper side and a portion near the second transfer portion 14 (the side near the second transfer member) is arranged at a lower side. Also, the intermediate transfer belt 11 is a consumable part, and hence the intermediate transfer belt 10 is detachably mountable on the apparatus body. The intermediate transfer belt 11 can be mounted and detached in a B direction in FIG. 1. The mounting-detaching operation includes opening a door 16 serving as a first open-close member, pulling out the intermediate transfer unit 10 in the B direction indicated by an arrow in FIG. 1, replacing the pulled out intermediate transfer unit 10 with a new intermediate transfer unit 10, and closing the door 16. Thus, the operation is completed. With a container 40 according to this embodiment, when detecting means detects a full state, the full-state is indicated on an operation panel, and then a user or a service personnel performs a replacement operation. Also, the container 40 is individually detachably mountable on the image forming apparatus. The operation includes opening the cover 17 serving as a second open-close member, pulling out the container 40 in a C direction indicated by an arrow in FIG. 1, replacing the pulled out container 40 with a new container 40, and closing the cover 17. Thus, the operation is completed. Mounting-detaching configurations of the intermediate transfer unit 10 and the container 40 are described later.

The toner images on the photosensitive drums 5 developed by the development rollers 7 are first-transferred on the intermediate transfer belt 11. The first transfer is performed at the first transfer portion that is formed by the first transfer rollers 10*y*, 10*m*, 10*c*, and 10*k* and the photosensitive drums 5. At the first transfer portion, toners are transferred on the intermediate transfer belt 11 by applying plus bias voltage to the first transfer rollers 10*y*, 10*m*, 10*c*, and 10*k*, and hence using a potential difference between the first transfer rollers 10*y*, 10*m*, 10*c*, and 10*k* and the surfaces of the photosensitive drums 5 charged with minus electricity.

The toner images first-transferred on the intermediate transfer belt 11 are transferred on a transfer material at the second transfer portion that is formed by the second transfer facing roller 14*a* and the second transfer roller 14*b*. Then, the transfer material passes through a fixing device 18 for performing fixing. Then, the conveying path of the transfer material is changed by a both-side flapper 19, and is conveyed to one of an output roller pair 20 and a switch-back roller pair 21. The transfer material conveyed to the switch-back roller pair 21 is conveyed at the switch-back roller pair 21 in a reversed manner, passes through the second transfer portion 14 and the fixing device 18 again, and then is conveyed to the output roller pair 20. After the transfer material passes through the output roller pair 20, the transfer material is output to a transfer material stack portion 22. Also, sheet feeding-conveying means 23 is arranged below the intermediate transfer belt 11 and an inclined side wall surface of the process cartridge 4*k* located near the second transfer portion. This arrangement makes a contribution to the decrease in size of the image forming apparatus.

Figure 2:
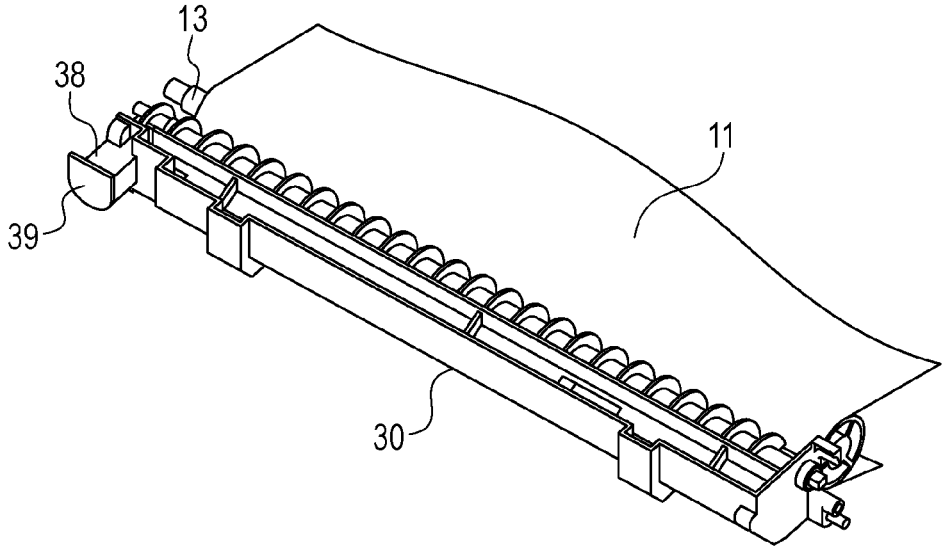
FIG. 2 is a perspective view of a cleaning device 30 according to the first embodiment.
Figure 3:
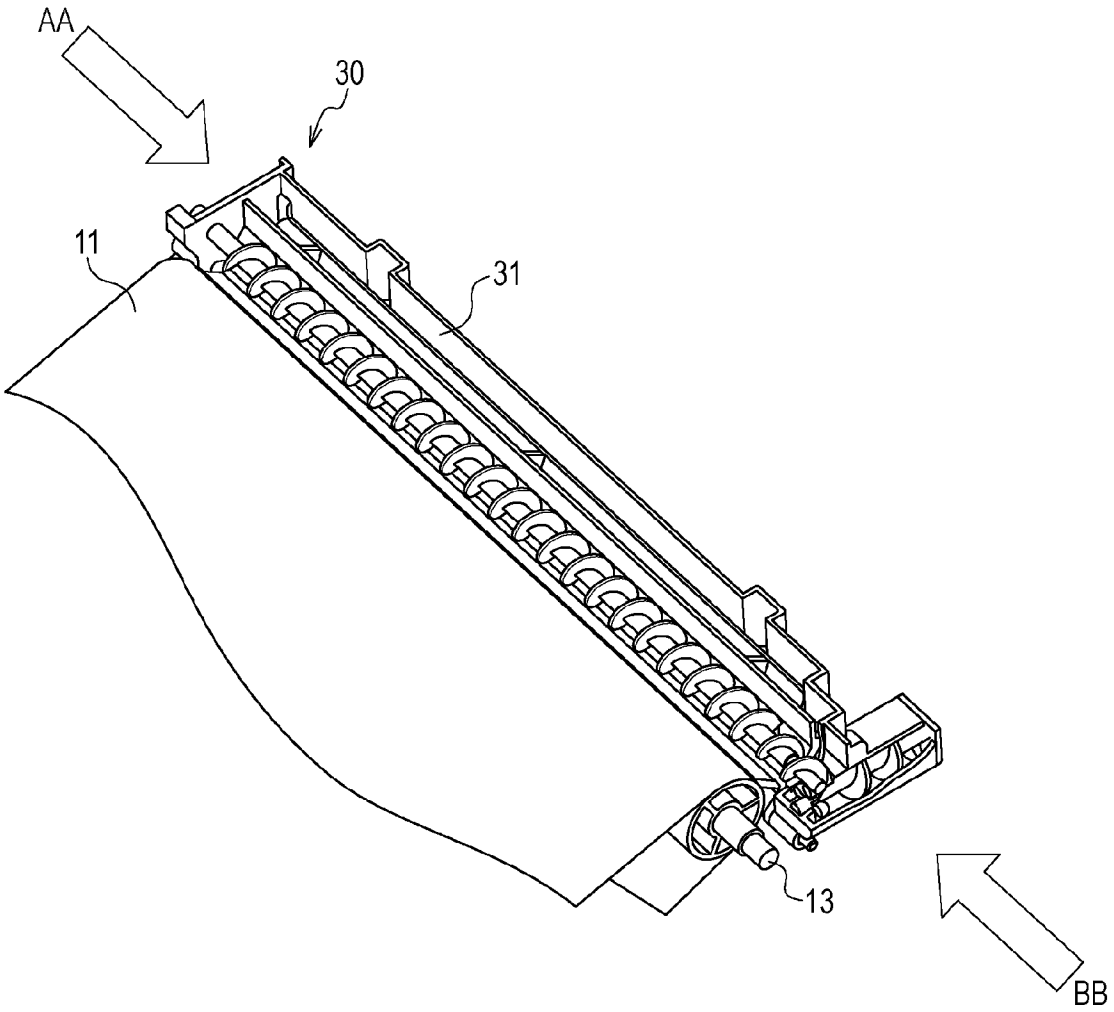
FIG. 3 is a perspective view of the cleaning device 30 according to the first embodiment.
Figure 4:
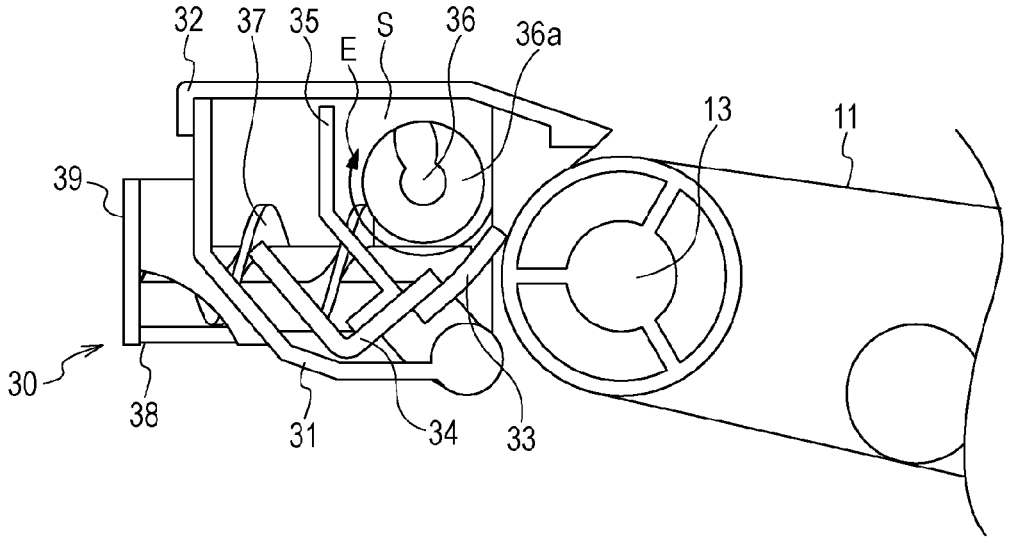
FIG. 4 is a cross-sectional view of the cleaning device 30 according to the first embodiment.
Figure 5:
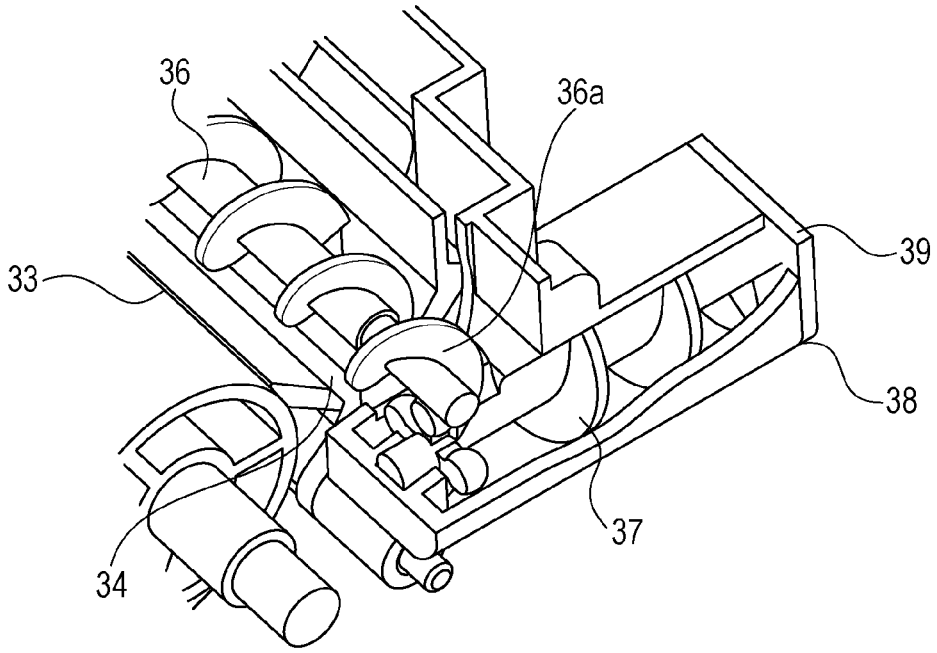
FIG. 5 is a perspective view of the cleaning device 30 according to the first embodiment.
Figure 6A:
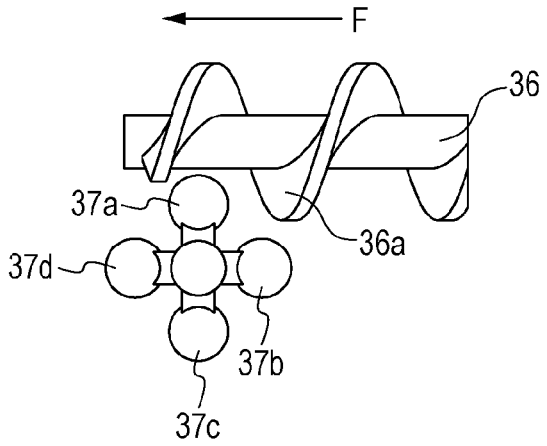
FIGS. 6A to 6C are each an explanatory view of connection for driving of a toner discharging screw 37 according to the first embodiment.
Figure 6B:
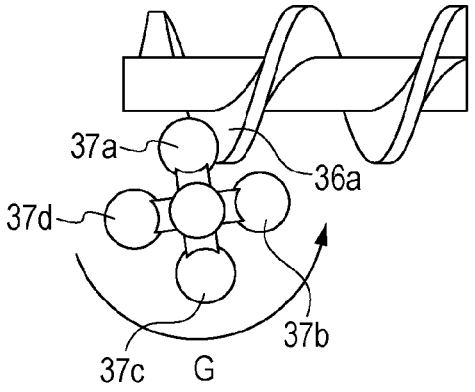
Figure 6C:
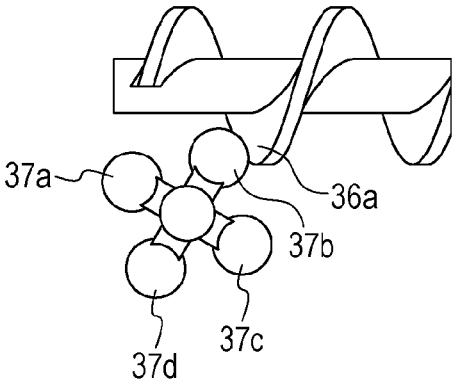

The cleaning device 30 is described in detail with reference to FIGS. 2, 3, 4, and 5. FIG. 2 is a perspective view showing the cleaning device 30 and the intermediate transfer belt 11 when viewed from the front side of FIG. 1. FIG. 3 is a perspective view of the cleaning device 30 and the intermediate transfer belt 11 when viewed from a side opposite to FIG. 2, i.e., from the back side of FIG. 1. FIG. 4 is a cross-sectional view explaining the cleaning device 30 when viewed in an AA direction in FIG. 3. FIG. 5 is an enlarged perspective view explaining the cleaning device 30 when viewed in a BB direction in FIG. 3. FIGS. 6A to 6C are each an illustration explaining connection for driving of the toner discharging screw 37.

As shown in FIG. 2, the cleaning device 30 has a toner discharge port 38 protruding to one-end side and a shutter 39 that closes the protruding port.

Also, as shown in FIGS. 3 and 4, the cleaning device 30 includes a cleaning container 31, a top cover 32, a cleaning blade 33, a blade holding metal sheet 34, and a toner conveying wall 35. Further, the cleaning device 30 has therein a toner conveying screw 36, the toner discharging screw 37, the toner discharge port 38, and the shutter 39. As shown in FIGS. 2 and 3, the cleaning device 30 is provided such that the cleaning blade 33 contacts the intermediate transfer belt 11 along a direction orthogonal to the rotation direction of the intermediate transfer belt 11 (in the width direction of an intermediate transfer member).

The cleaning blade 33 uses deformable elastic rubber as a material, and is bonded to the blade holding metal sheet 34. The cleaning blade 33 has a width that is larger than a maximum size with which the image forming apparatus can perform image formation in the longitudinal direction. The cleaning blade 33 is pressed to the intermediate transfer belt 11 and removes the toner on the intermediate transfer belt 11. Also, to obtain a desirable linear pressure with which the toner can be removed, the cleaning blade 33 is generally pressed to any of various rollers provided inside the intermediate transfer belt 11. In this embodiment, the cleaning blade 33 is pressed to the tension roller 13. The toner conveying wall 35, which is made of plastic, is attached to the blade holding metal sheet 34. A space S is formed by the cleaning blade 33, the blade holding metal sheet 34, the toner conveying wall 35, and the top cover 32. The toner conveying screw 36 is arranged in the space S. The toner conveying screw 36 is rotatably held by the cleaning container 31 at both ends of the toner conveying screw 36. Driving is transmitted to the toner conveying screw 36 by a driving gear (not shown) provided at an end portion of the toner conveying screw 36, and the toner conveying screw 36 rotates in a toner conveying direction (in an E direction indicated by an arrow in FIG. 4).

The toner scraped from the intermediate transfer belt 11 by the cleaning blade 33 starts accumulating on the cleaning blade 33, and also starts gradually accumulating on the blade holding metal sheet 34. Then, the toner which comes into contact into the toner conveying screw 36 is conveyed to an end portion in the longitudinal direction (to the toner discharging screw 37) by a blade 36*a*.

As shown in FIG. 5, the toner passed from the toner conveying screw 36 is conveyed to the toner discharge port 38 by the toner discharging screw 37. When the intermediate transfer unit 10 is detached or mounted for the replacement operation or the like, if the toner discharge port 38 is exposed, the toner may leak and fall, and may contaminate the inside of the image forming apparatus. To prevent this, the cleaning device 30 includes the shutter 39 serving as the open-close member that opens and closes the toner discharge port 38. The toner discharging screw 37 is arranged directly below the toner conveying screw 36, in a posture substantially orthogonal to the toner conveying screw 36.

Next, a connection configuration for driving between the toner conveying screw 36 and the toner discharging screw 37 is described with reference to FIGS. 6A to 6C. A boss 37*a*, a boss 37*b*, a boss 37*c*, and a boss 37*d* are provided respectively at an angle of 90° at an upstream end in the toner conveying direction of the toner discharging screw 37. The bosses 37*a* to 37*d* each have a spherical tip end. When the toner conveying screw 36 rotates, since the blade 36*a* has a spiral shape, the blade 36*a* moves in an F direction indicated by an arrow in FIG. 6A. When the blade 36*a* comes into contact with the boss 37*a*, the toner discharging screw 37 starts rotating in a G direction indicated by an arrow in FIG. 6B. When the toner conveying screw 36 further rotates, the blade 36*a* is separated from the boss 37*a*, and starts coming into contact with the boss 37*b* (FIG. 6C). Then, the blade 36*a* successively comes into contact with the boss 37*c*, the boss 37*d*, and then the boss 37*a* again. Thus, the toner discharging screw 37 rotates by one turn. This series of motions is continuously repeated, and hence the toner discharging screw 37 smoothly rotates. If a large gap is provided between the blade 36*a* and the bosses 37*a*, 37*b*, 37*c*, and 37*d*, the screws are prevented from being locked by the toner which is complicatedly tangled with paper fibers and is aggregated. Driving is properly transmitted. Also, the toner conveying screw 36 and the toner discharging screw 37 directly contact each other and driving is transmitted at the pass portion for the toner. Hence, filling or clogging of the toner at the connection portion is reliably prevented.

Driving is transmitted to the toner discharging screw 37 such that the blade 36*a* moves the bosses 37*a* to 37*d* according to this embodiment. However, another transmission mechanism for driving may be used. For example, it may be assumed that the blades of the screws are screw gears (helical gears with a helix angle of 45°), and the blades may directly contact each other for transmitting driving. Also, the four bosses 37*a* to 37*d* are provided; however, the number of bosses may be changed to adjust the conveyance amount of the toner. Even if the number of bosses provided at the discharge screw 37 is changed, the advantage of the present invention is not changed.

Figure 7:
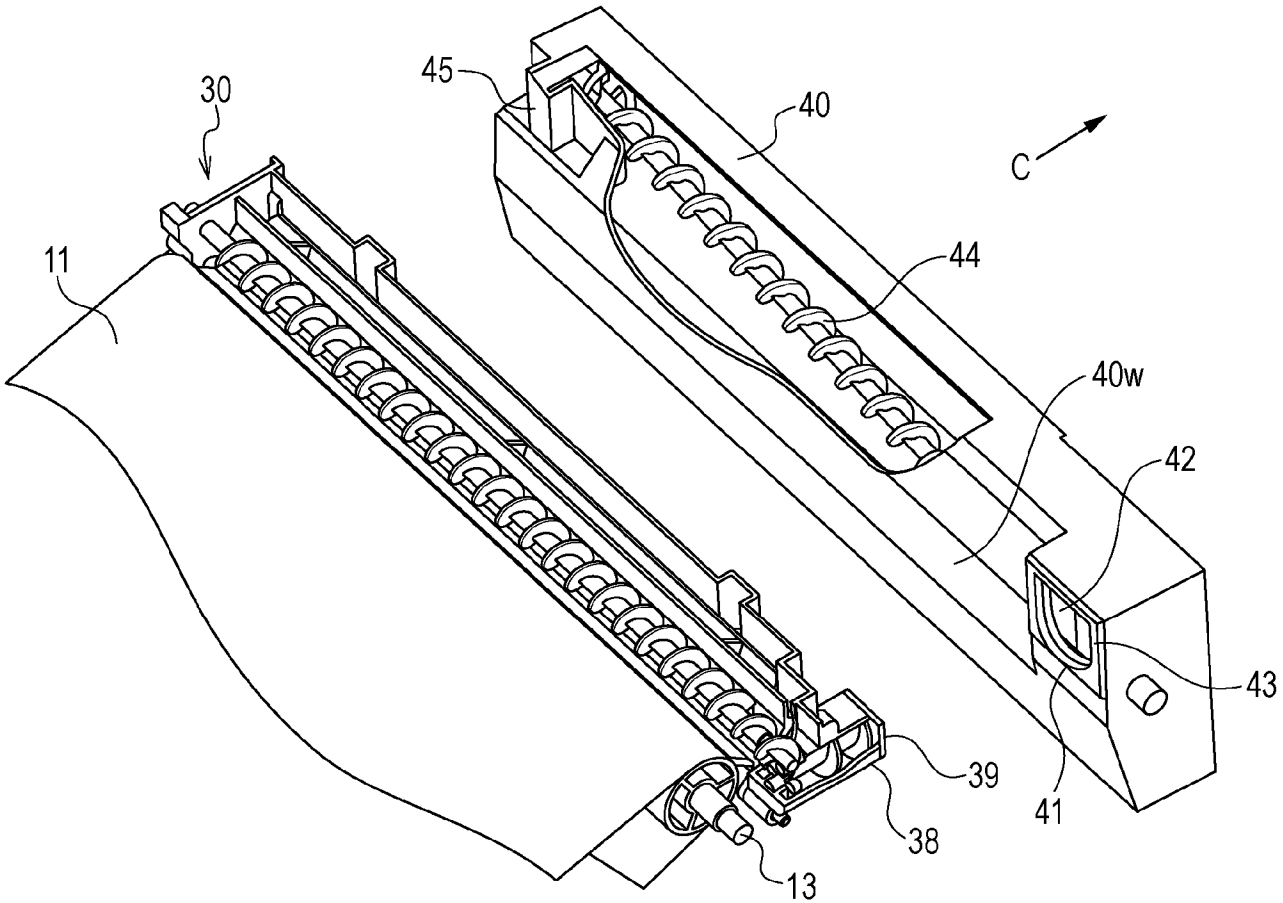
FIG. 7 is a state diagram when a container 40 is detached from the image forming apparatus according to the first embodiment.
Figure 8:
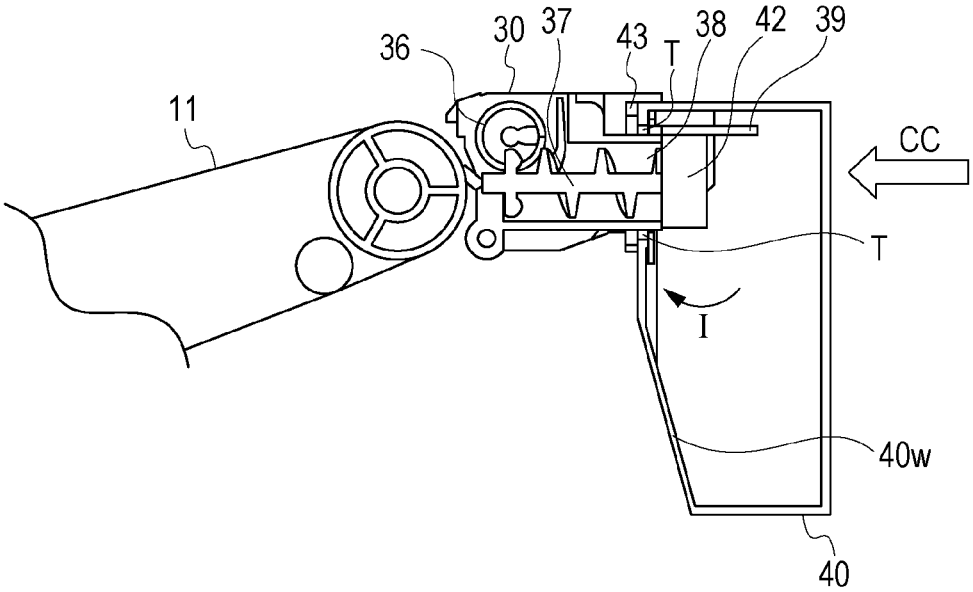
FIG. 8 is a state diagram when the container 40 is arranged at a predetermined position in the image forming apparatus according to the first embodiment.

The container 40 is described in detail with reference to FIGS. 7 and 8. FIG. 7 is a state diagram when the container 40 is detached from the image forming apparatus. FIG. 8 is a state diagram when the container 40 and the cleaning device 30 are connected, FIG. 8 being a cross-sectional view in the BB direction in FIG. 3.

As shown in FIG. 7, the container 40 has a toner inflow port 41, a cap 42, a seal member 43, a toner crushing screw 44, and a detection window 45. The container 40 has a dimension substantially equivalent to a dimension of the intermediate transfer unit 10 in the width direction. Since the container 40 is individually detachably mountable on the image forming apparatus body in the C direction indicated by the arrow in FIG. 7, a service personnel or a user can easily replace the container 40 with new one.

As described above, the intermediate transfer unit 10 is detachably mountable on the apparatus body, and the mounting direction of the intermediate transfer unit 10 is opposite to the protruding direction of the toner discharge port 38. The toner inflow port 41 is provided at an upper end portion of a side wall surface 40*w* of the container 40. The periphery of the toner inflow port 41 is covered with the seal member 43.

Figure 9:
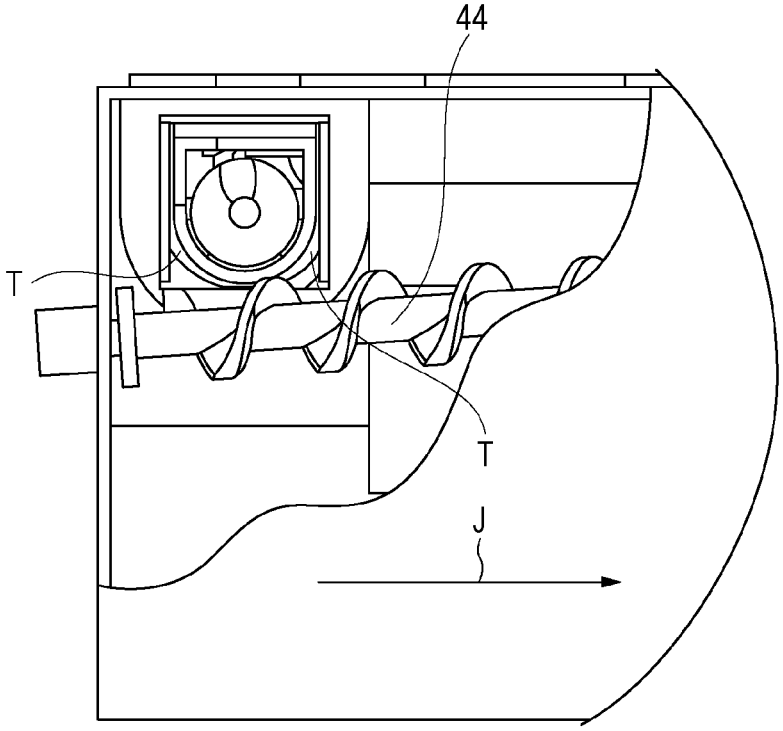
FIG. 9 is a cross-sectional view of the container 40 and the cleaning device 30 when viewed in a CC direction in FIG. 8.

As shown in FIG. 8, when the toner discharge port 38 of the cleaning device 30 is fitted to and connected with the container 40, the seal member 43 is pinched and compressed between the cleaning device 30 and the container 40. Since the seal member 43 completely seals a gap T between the toner discharge port 38 and the toner inflow port 41, the toner is prevented from leaking to the outside. FIG. 9 is an enlarged view when FIG. 8 is viewed in the CC direction. As shown in FIG. 9, the toner discharge port 38 connected with the toner inflow port 41 of the container 40 has a small gap T generated with respect to the toner inflow port 41.

Figure 10:
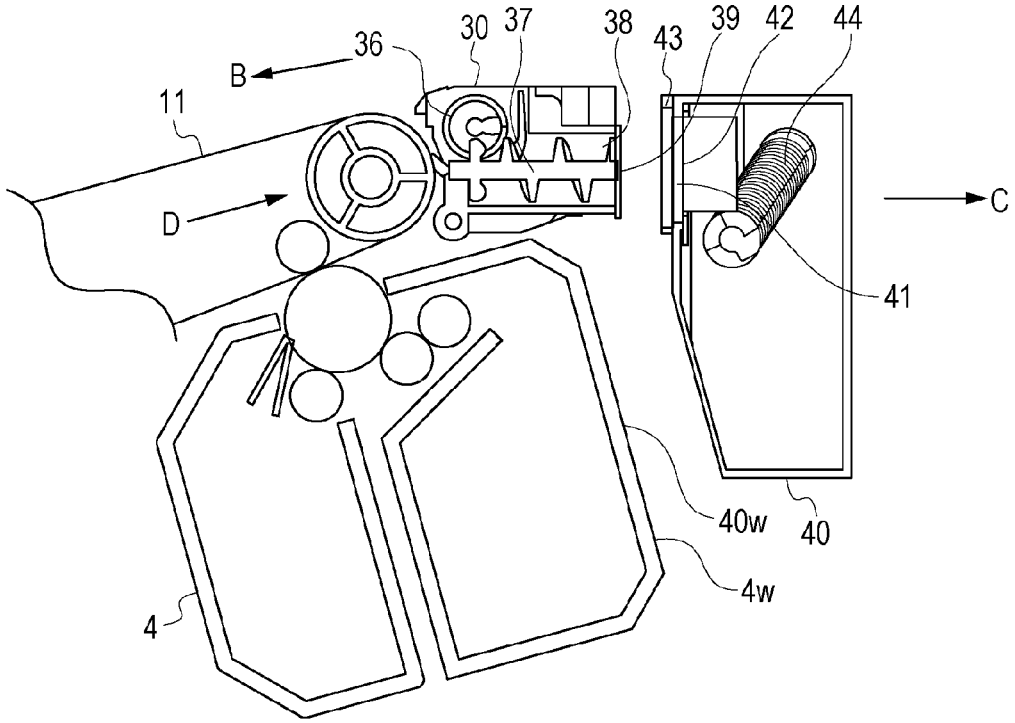
FIG. 10 is a cross-sectional view explaining a mounting-detaching direction of the container 40 and a mounting-detaching direction of the cleaning device 30 according to the first embodiment.

As shown in FIG. 10, in this embodiment, the mounting-detaching direction C of the container 40 is substantially horizontal to the movement and mounting-detaching direction B of the cleaning device 30, and the urging direction D of the tension roller 13. Also, the mounting-detaching direction C of the container 40 is reverse to the mounting-detaching direction of the intermediate transfer unit 10. Hence, even if the mounting-detaching loci of the container 40 and the cleaning device 30 and the positional variation of the tension roller 13 are taken into consideration, the gap T at the connection portion of both can be minimized (in this embodiment, 1.5 mm or smaller) as shown in FIGS. 8 and 9.

As shown in FIGS. 8 and 10, when the cleaning device 30 is connected with the container 40, the shutter 39 of the cleaning device 30 is opened, and the toner discharge port 38 is connected with the toner inflow port 41. The toner discharge port 38 is arranged inside the container 40 from the toner inflow port 41 and is connected with the toner inflow port 41 in an overlap manner. Also, the seal member 43 uses an elastic member made of polyurethane. It is to be noted that, in a state in which the container 40 is arranged in the image forming apparatus, if the intermediate transfer unit 10 is mounted on the image forming apparatus, the shutter 39 is also opened in a similar manner.

Also, the toner discharge port 38 is arranged above a side wall surface 4*w* of the process cartridge 4. The toner flowing into the container 40 from the toner discharge port 38 starts accumulating on a bottom portion of the container 40 from an area near a lower portion of the toner discharge port 38. The toner crushing screw 44 is provided directly below the toner discharge port 38. Driving is transmitted from the toner conveying screw 36 to a driving gear (not shown) provided at an outer wall surface of the container 40 through an idler gear (not shown) arranged in the image forming apparatus. Hence, the toner crushing screw 44 rotates in a toner conveying direction (an I direction indicated by an arrow in FIG. 8). When the accumulation of the toner progresses and the toner starts contacting the toner crushing screw 44, the toner crushing screw 44 conveys the toner to an end opposite to the toner inflow port 41 (in a J direction indicated by an arrow in FIG. 8). Since the toner crushing screw 44 is provided in the container 40, filling efficiency of the toner to the container 40 can be increased, and replacement frequency of the container 40 can be decreased. Also, since driving is transmitted to the toner crushing screw 44 from the toner conveying screw 36, a transmission member for driving can be omitted. The size and cost of the image forming apparatus can be decreased, and the transmission configuration for driving can be simplified.

The detection window 45 made of transparent plastic is provided at an upper portion of the container 40 at an opposite end in the width direction of the intermediate transfer belt 11 (see FIG. 7). The image forming apparatus includes a detection sensor (not shown). When the detection window 45 is filled with the toner, light to the sensor is shielded, and hence the sensor detects a full-state. The full-state is indicated on the operation panel, and the indication notifies a user or a service personnel of that the container 40 becomes full. Also, a sensor (not shown) that detects the presence of the container 40 is provided. The sensor can notify the user or the service personnel of that the container 40 is not mounted. The cover 17 is opened, the container 40 is detached in the C direction indicated by the arrow as shown in FIG. 10, an empty container 40 is set at a predetermined position, and then the cover 17 is closed. Thus, the image forming apparatus can become continuously used.

Figure 11:
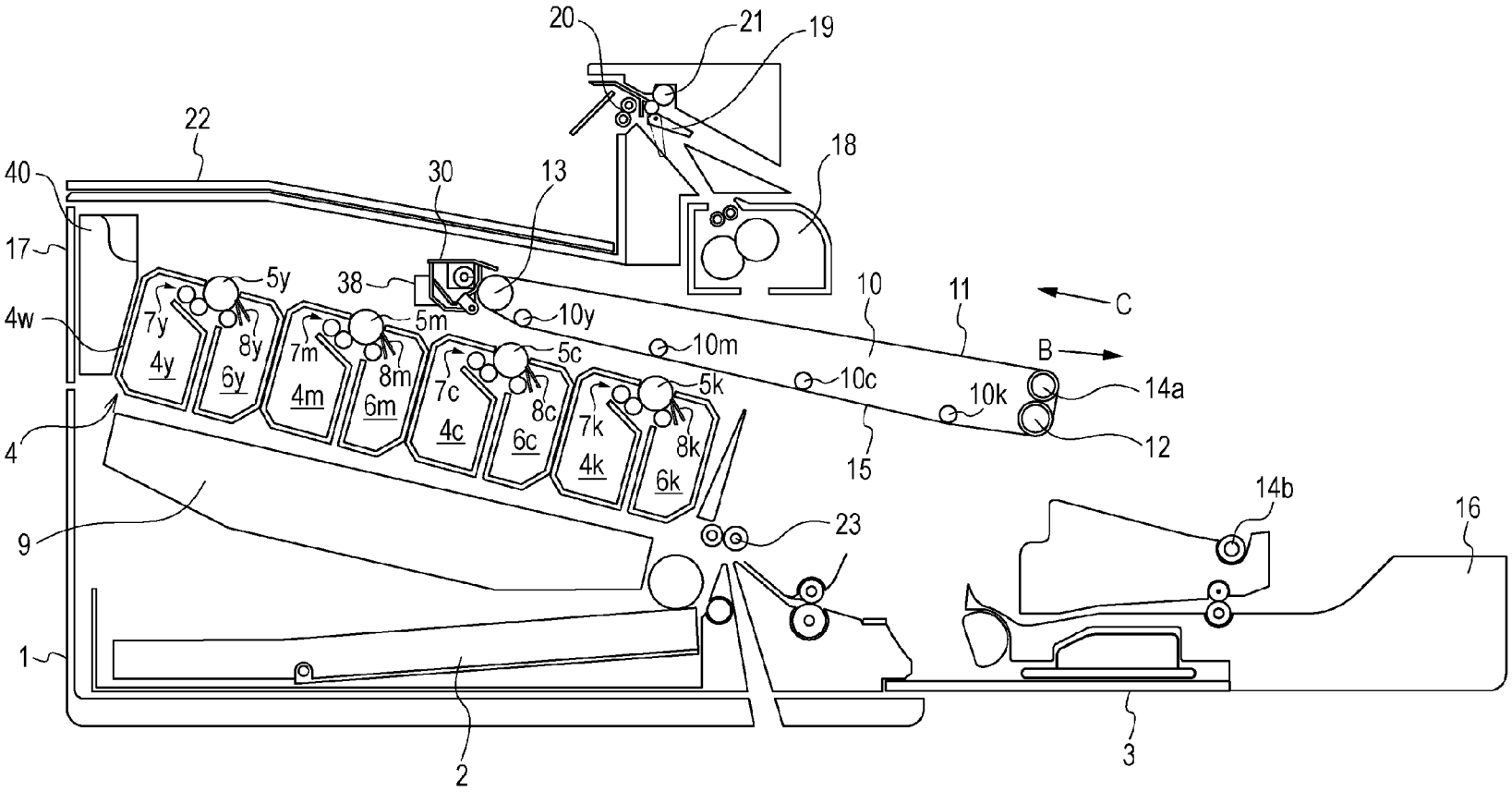
FIG. 11 is a cross-sectional view explaining a state in which a transfer unit is mounted on and detached from an apparatus body according to the first embodiment.

A mounting-detaching method of the intermediate transfer unit 10 is described in detail with reference to FIG. 11. FIG. 11 is a cross-sectional view when the image forming apparatus in FIG. 1 is viewed in the front direction. First, the door 16 provided at the right side surface of the printer 1 is opened. At this time, a second transfer unit 24 that holds the second transfer roller 14*b* is also opened, and the right side surface of the intermediate transfer unit 10 is completely exposed. In this state, the intermediate transfer unit 10 can be easily pulled out in the right direction (in the B direction in the drawing). The second transfer unit 24 does not have to be integrated with the right door 16. Even if the second transfer unit 24 and the right door 16 may be individually opened and closed, this configuration does not affect the advantage of the present invention. When the intermediate transfer unit 10 is pulled out from the apparatus body, the engagement between the cleaning device 30 and the container 40 is released, and the shutter 39 is closed as shown in FIG. 8. When the intermediate transfer unit 10 is mounted, the intermediate transfer unit 10 is moved in the left direction (the C direction in the drawing) that is the mounting direction. When the cleaning device 30 is connected with the container 40 by the movement of the intermediate transfer unit 10, the shutter 39 of the cleaning device 30 is opened, and the toner discharge port 38 is connected with the toner inflow port 41.

Figure 12:
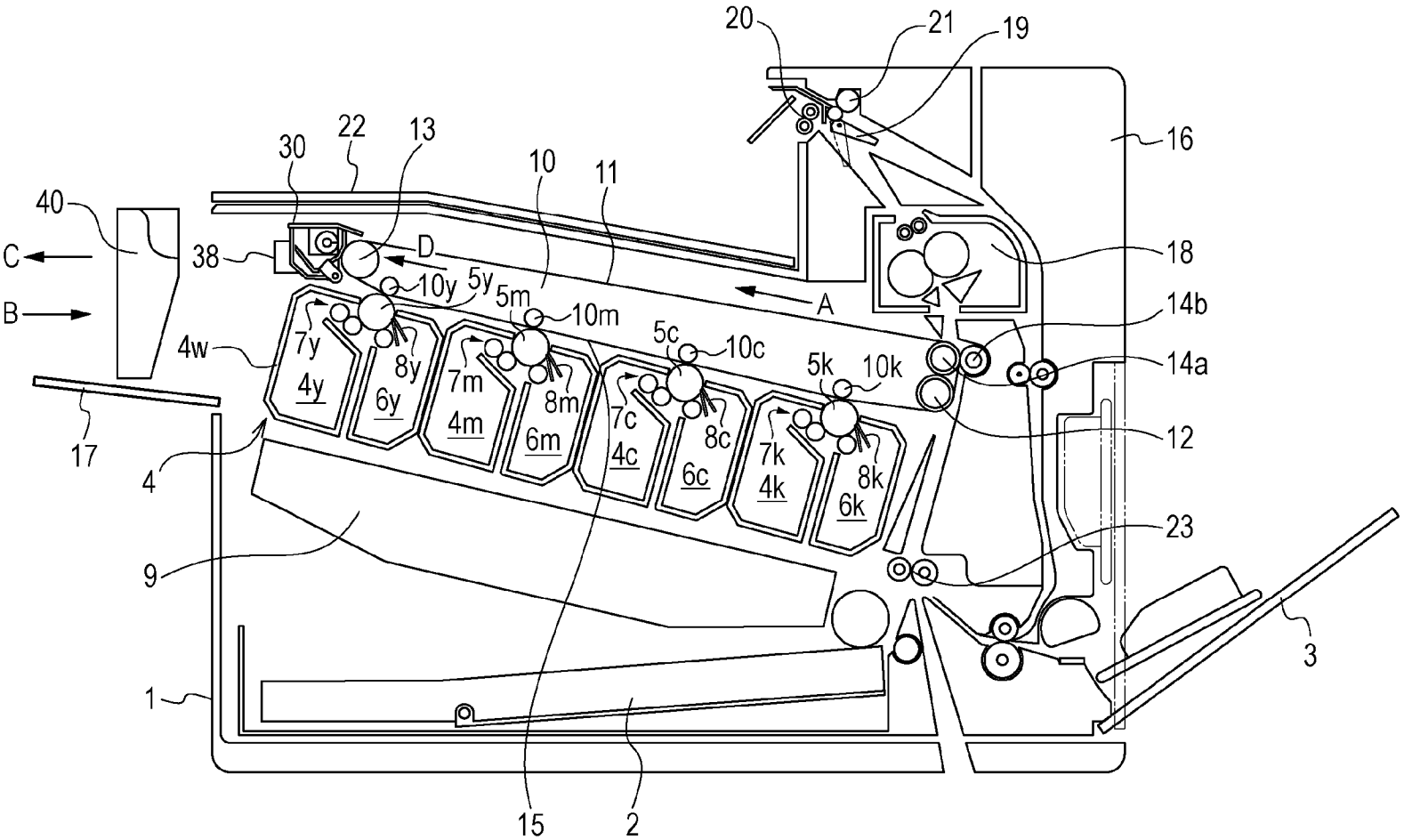
FIG. 12 is a cross-sectional view explaining a state in which the container 40 is mounted on and detached from the apparatus body according to the first embodiment.

A mounting-detaching method of the container 40 is described in detail with reference to FIG. 12. FIG. 12 is a cross-sectional view when the image forming apparatus in FIG. 1 is viewed in the front direction. The cover 17 provided at the left side surface of the printer 1 is opened. In this state, the container 40 can be easily pulled out in the left direction (the C direction in the drawing). Similarly to the detaching and mounting of the intermediate transfer unit 10, when the container 40 is pulled out, the shutter 39 of the cleaning device 30 of the intermediate transfer unit 10 is closed. When the container 40 is mounted, the container 40 is moved in the right direction that is the mounting direction (the B direction in the drawing). When the cleaning device 30 is connected with the container 40 by the movement of the container 40, the shutter 39 of the cleaning device 30 is opened, and the toner discharge port 38 is connected with the toner inflow port 41.

As shown in FIG. 10, the protruding direction of the toner discharge port 38 of the cleaning device 30 is substantially the same direction as the mounting-detaching direction of the container 40 (the C direction in the drawing). Owing to this, even if the gap T between the toner inflow port 41 and the toner discharge port 38 shown in FIGS. 8 and 9 is minimized, the detachment can be performed. In contrast, of course, the insertion can be also performed.

With the above-described configuration, the toner conveying path can be shortened and the gap T required for the connection portion can be minimized. Hence, the configuration including the seal member can be simplified and the cost can be decreased. Also, since the toner discharge port 38 and the toner inflow port 41 provided at the container 40 are directly connected with each other in an overlap manner, even if vibration or an impact is applied to the image forming apparatus, the toner can be prevented from leaking in the image forming apparatus. With this configuration, the toner conveying path can be shortened, simplified, and decreased in cost. Also, even if vibration or an impact is applied to the image forming apparatus, a gap is not generated between the toner discharge port 38 and the toner inflow port 41. The toner can be prevented from leaking in the image forming apparatus.

Also, the container 40 can be mounted and detached in the C direction indicated by the arrow shown in FIG. 1 by opening and closing the cover 17. The container 40 can be mounted and detached individually from the image forming apparatus in the reverse direction of the direction of the cleaning device 30, i.e., the intermediate transfer unit 10. The replacement operation of the container 40 can be performed by simple procedures. The cover 17 is a cover for mounting and detaching only the container 40. The replacement of the container 40 has no relation to image formation or conveyance of a transfer material. Since the mounting and detaching are available in a direction not relating to image formation or conveyance of a transfer material, there is no need of a preparation motion that brings an apparatus state into a printing available state every time when the container 40 is mounted and detached. Unnecessary use of electric power or unnecessary downtime can be eliminated.

Figure 13:
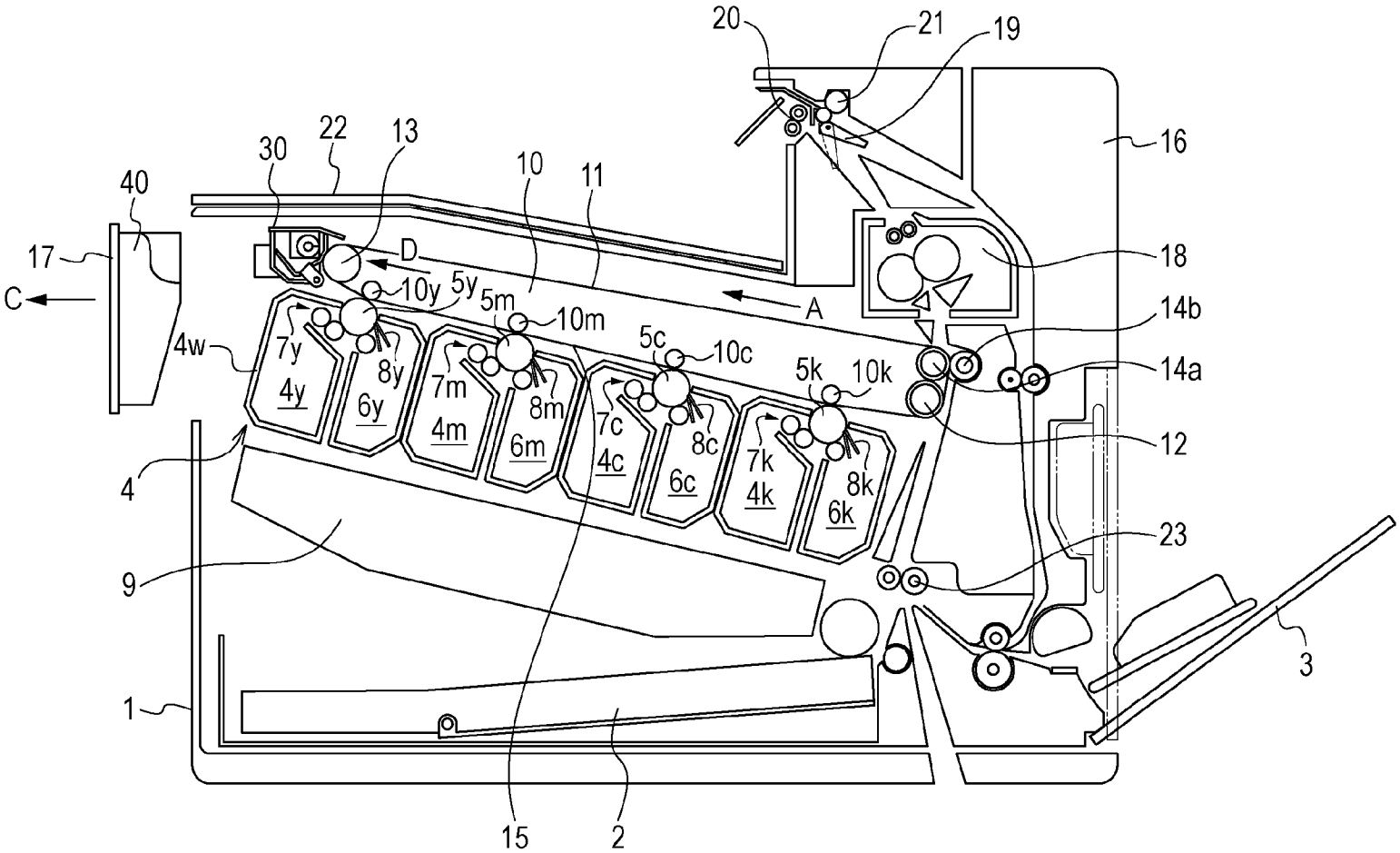
FIG. 13 is a cross-sectional view explaining a state in which the container 40 that is integrated with a cover 17 is mounted on and detached from the apparatus body according to the first embodiment.

Also, as shown in FIG. 13, the container 40 may be integrated with the cover 17. As the result of the integration, the cover does not have to be opened and closed during the replacement operation, and hence efficiency of the replacement operation can be increased.

Also, in the image forming apparatus according to this embodiment, the first transfer surface 15 of the intermediate transfer unit 10 is arranged in an inclined manner such that the portion near the second transfer portion 14 is arranged at the lower side and the portion near the cleaning device 30 is arranged at the upper side. Since the process cartridges 4*y*, 4*m*, 4*c*, and 4*k* are shifted to the upstream side in the rotation direction of the intermediate transfer belt 11, the excessive space is generated below the intermediate transfer belt 11 and the inclined side wall surface of the process cartridge 4*k* located near the second transfer portion (below the intermediate transfer belt 11 at the most downstream side). The sheet feeding-conveying means 23 is arranged in the excessive space, and hence the image forming apparatus is decreased in size.

Also, the cleaning device 30 is arranged at the same position in the height direction as the position of the tension roller 13 in the apparatus to decrease the height of the entire apparatus.

Figure 14:
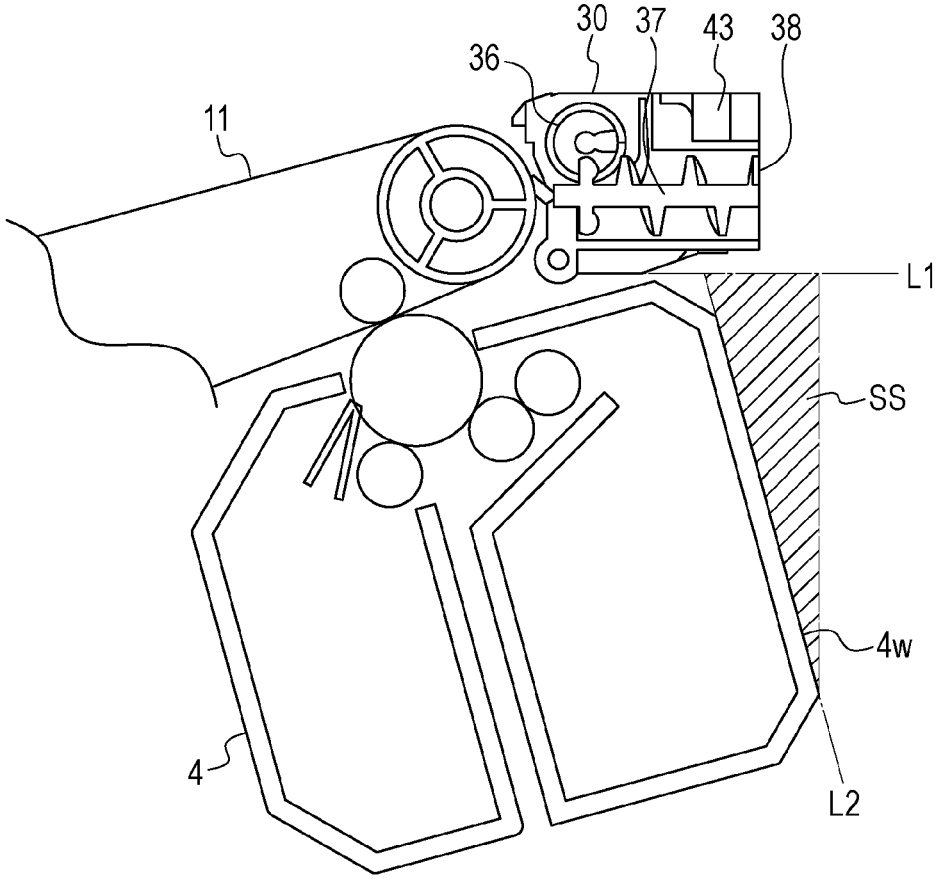
FIG. 14 is an illustration explaining a space with a substantially triangular cross section according to the first embodiment.

As described above, the container 40 is at least partly arranged in a space that is formed below the cleaning device 30 and above the inclined side wall surface 4*w* of the process cartridge 4*y* arranged at the most upstream side in the rotation direction of the intermediate transfer member. To be more specific, as shown in FIG. 14, the container 40 is at least partly arranged in a space SS having a substantially triangular cross section and formed by an imaginary line L1 that is horizontal to the lower portion of the cleaning device 30 and an imaginary line L2 that is horizontal to the inclined side wall surface 4*w* of the process cartridge 4*y*. With this arrangement, the cleaning device and the mountable and detachable container can be arranged as closely as possible without an increase in size of the image forming apparatus.

Also, a surface of the container facing the process cartridge 4*y* is an inclined surface parallel to the inclined side wall surface 4*w*. Hence, the container 40 can be arranged closer to the process cartridge 4*y*. Hence, the toner can be directly dropped in the space with the substantially triangular cross section. Accordingly, the toner can be efficiently housed in the container 40. Also, the surface on which the toner is landed in the container 40 is an inclined surface. Hence, the toner can be gently landed. Accordingly, scattering of the toner in the container 40 can be minimized, and the detection can be stably performed without being affected by scattering of the toner.

Also, since the container 40 is provided in the space with the substantially triangular cross section and extends along a long region in the width direction of the intermediate transfer belt 11, a sufficient toner housing capacity can be provided, and the frequency of replacement for the container 40 can be decreased.

Second Embodiment

A full-color laser beam printer 1 (hereinafter, printer 1) according to a second embodiment of the present invention is similar to that according to the first embodiment except the configuration of a cleaning device. Hence, the description for the printer 1 is omitted. A feature portion of arrangement configuration of the cleaning device that is different from that of the first embodiment is described with reference to FIGS. 15 and 16.

Figure 15:
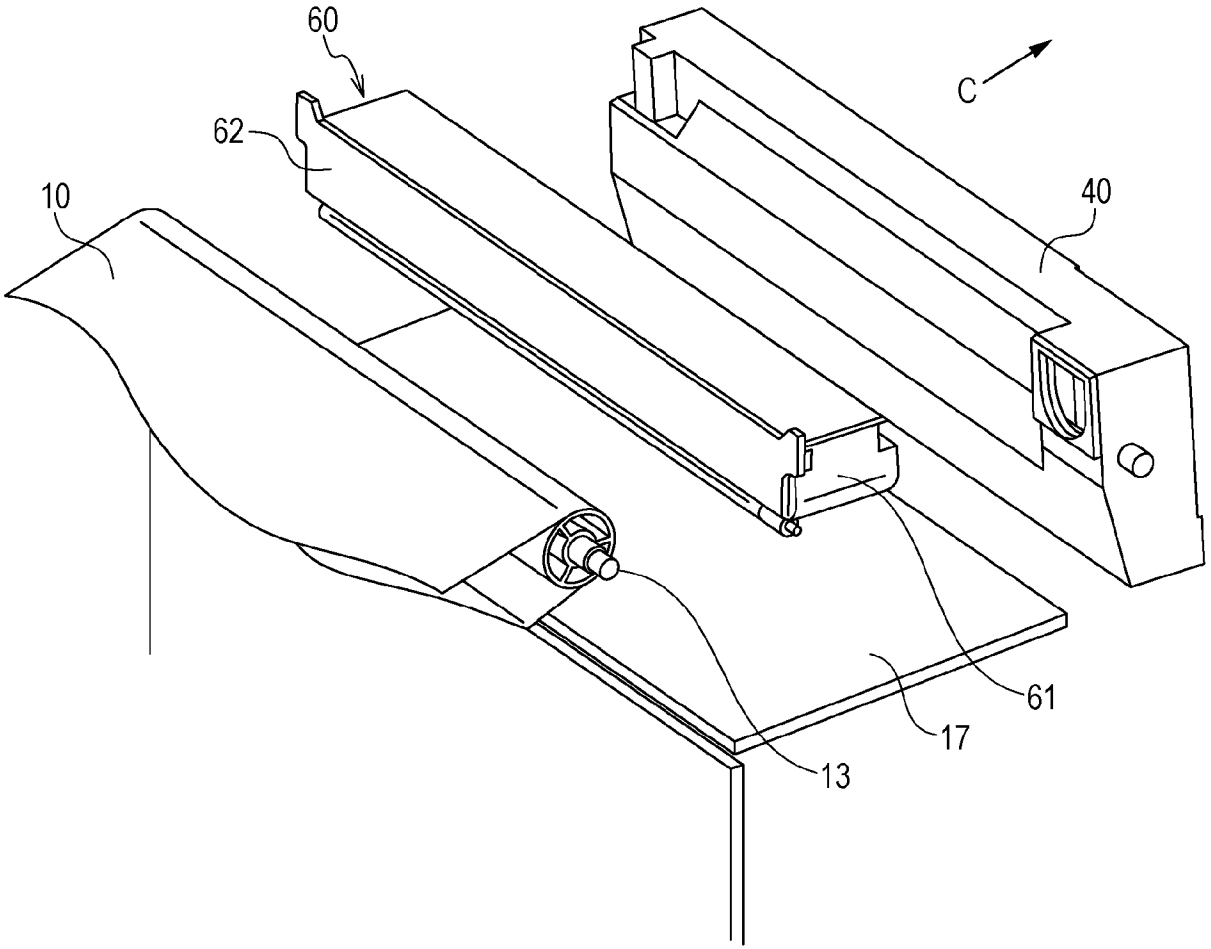
FIG. 15 is an explanatory view of configurations of a cleaning device 60 and a container 40 according to a second embodiment.
Figure 16A:
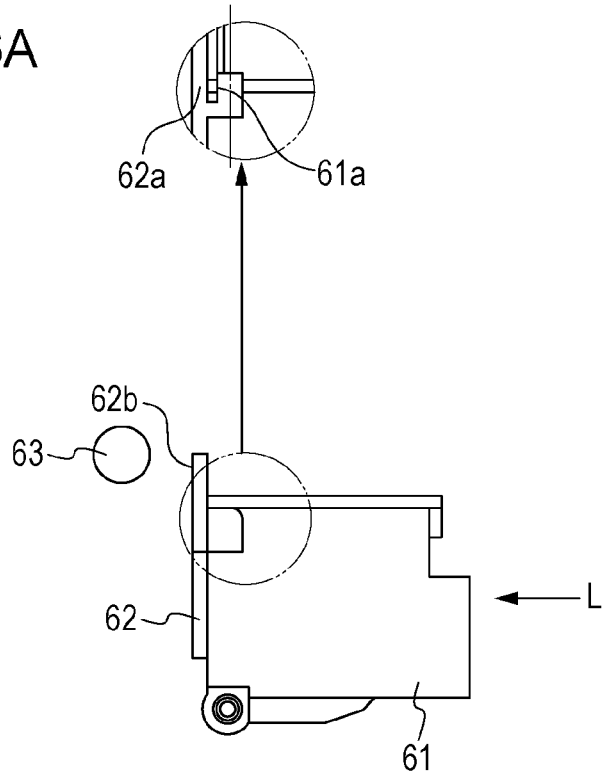
FIGS. 16A and 16B are each an explanatory view of opening and closing of a shutter 62 according to the second embodiment.
Figure 16B:
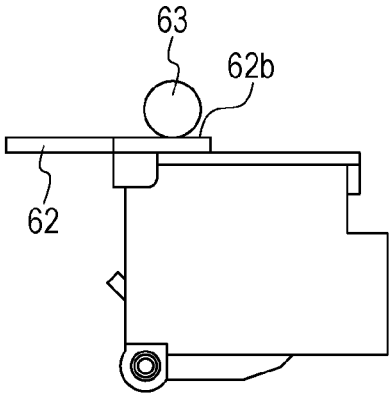

FIG. 15 is an explanatory view of configurations of a cleaning device 60 and a container 40. FIGS. 16A and 16B are each an explanatory view of opening and closing of the shutter 62. As shown in FIG. 15, the cleaning device 60 and the container 40 are configured independently from each other. By opening and closing the cover 17, the cleaning device 60 and the container 40 can be mounted and detached in the C direction indicated by the arrow in FIG. 15.

The cleaning device 60 has an inner configuration equivalent to that of the first embodiment, and hence the description thereof is omitted. Only a feature portion different from the first embodiment is described. The cleaning device 60 includes a cleaning container 61 and the shutter 62. The shutter 62 has a dimension substantially equivalent to a dimension in the longitudinal direction of the cleaning device 60. The shutter 62 is provided to close an opening when the cleaning device 60 is mounted and detached.

As shown in FIGS. 16A and 16B, a boss 62*a* and a contact portion 62*b* are provided at each of both ends of the shutter 62. The boss 62*a* is fitted to a hole 61*a* provided at the cleaning container 61, so that the shutter 62 is rotatably supported. Also, a spring (not shown) is provided at an end portion of the shutter 62. The spring continuously urges the shutter 62 in a close direction. As shown in FIG. 16A, the contact portion 62*b* comes into contact with a boss 63 provided in the image forming apparatus, and the shutter 62 starts rotating while the cleaning device 60 is being mounted.

The shutter 62 becomes fully opened before the cleaning device 60 is arranged at a predetermined position, and hence the image forming apparatus becomes available for use (FIG. 16B). The image forming apparatus measures a travel time of the intermediate transfer belt 11. When the travel time reaches a predetermined time, the end of the life of the cleaning device 60 is notified. When the cleaning device 60 reaches the end of the life, the operation panel (not shown) provided at the image forming apparatus body indicates the end of the life, and thus the user or service personnel performs the replacement operation. First, the cover 17 is opened, and the container 40 is detached in the C direction indicated by the arrow in FIG. 15. Then, the cleaning device 60 is detached in the same direction. During the detachment, the contact portion 62*b* is separated from the boss 63 and hence the shutter 62 is closed. Then, the cleaning device 60 is replaced with a new cleaning device 60, the detached container 40 is mounted, and the cover 17 is closed. Thus, the replacement operation is completed.

In this embodiment, the image forming apparatus having a configuration in which the cleaning device 60 is mounted and detached in a direction parallel to the C direction indicated by the arrow in FIG. 15. However, other configuration may be employed. For example, to further reduce leakage of a toner when the container 40 is mounted and detached, an image forming apparatus having a configuration in which a cleaning device 60 is mounted and detached while an opening of the cleaning device 60 is inclined upward may be provided.

According to this embodiment, the cleaning device 60 and the intermediate transfer unit 10 are independently provided. Accordingly, the cleaning device 60 and the intermediate transfer unit 10 can be mounted on and detached from the apparatus body at respectively optimal timings.

As described above, with the configuration of the present invention, the size of the image forming apparatus can be decreased and the container can be easily mounted on and detached from the cleaning device.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

The invention claimed is:

1. An image forming apparatus comprising:

an image bearing member that bears a toner image;

a transfer unit including a belt that transports the toner image on the image bearing member, and a cleaning device that removes a toner adhering to the belt, the transfer unit being detachably mountable on an apparatus body; and a container that houses the toner removed by the cleaning device, the container is detachably mountable on the apparatus body;

wherein, when the transfer unit and the container are mounted on the apparatus body, the belt, the cleaning device, and the container are arranged in that order along a mounting-detaching direction of the transfer unit, wherein a direction of a line formed by the arrangement of the belt, the cleaning device, and the container is nearly parallel to the mounting-detaching direction of the transfer unit, and wherein each of the transfer unit and the container are independently and respectively detachable with respect to the apparatus body, and mounting-detaching directions thereof are in opposite direction with each other.

2. The image forming apparatus according to claim 1, wherein a transport direction of the belt is a direction parallel to a moving direction of the belt in a region in which the belt faces the image bearing member.

3. The image forming apparatus according to claim 2, wherein the cleaning device includes a toner conveying member that conveys the toner removed from the belt by the cleaning device, in one direction orthogonal to the transport direction of the belt, the discharge portion being provided at an end portion in the one direction orthogonal to the transport direction of the belt.

4. The image forming apparatus according to claim 3 wherein the discharge portion has a discharge port, and includes a driven toner conveying member that conveys the toner, which is conveyed by the toner conveying member, from the toner conveying member to the discharge port and that is driven by the toner conveying member.

5. The image forming apparatus according to claim 4, wherein the toner conveying member has a screw shape having a plurality of blades, and wherein the driven toner conveying member is driven when the driven toner conveying member contacts the plurality of blades.

6. The image forming apparatus according to claim 2, wherein the container is provided to extend along a direction orthogonal to the transport direction of the belt.

7. The image forming apparatus according to claim 1, wherein a discharge portion is provided, the discharge portion extending in the mounting-detaching direction of the container, for discharging the toner removed by the cleaning device to the container, the discharge portion is provided at the cleaning device, and has a shape protruding from the cleaning device to the container.

8. The image forming apparatus according to claim 7, wherein the transfer unit includes a plurality of support members that support the belt, and an urging member, one of the plurality of support members being a tension roller that is urged by the urging member for applying a tension to the belt, the cleaning device facing the tension roller through the belt, a protruding direction of the discharge portion being parallel to an urging direction of the urging member.

9. The image forming apparatus according to claim 7, wherein, when the container is detached from the apparatus body, the container is detached in a direction substantially horizontal to a protruding direction of the discharge portion.

10. The image forming apparatus according to claim 7, wherein the container has an inflow port into which the toner discharged from the discharge portion flows, and if the transfer unit is mounted on the apparatus body while the container is mounted on the apparatus body, the discharge portion is arranged inside the inflow port when the transfer unit is mounted.

11. The image forming apparatus according to claim 7, wherein the cleaning device includes an open-close member that opens and closes the discharge port, the open-close member being opened when the cleaning device and the container are mounted.

12. The image forming apparatus according to claim 1, wherein the container is integrated with part of a cover that forms the apparatus body, the container being detachably mountable on the apparatus body together with the cover.

13. The image forming apparatus according to claim 1, wherein the container includes a toner crushing member that crushes a toner accumulating inside.

14. The image forming apparatus according to claim 1, wherein a plurality of the image bearing members are arranged in line along the transport direction of the belt, and each are provided as a unit serving as an image forming unit, wherein the belt is an intermediate transfer belt on which toner images are respectively first-transferred from the image bearing members of the plurality of image forming units, wherein the apparatus body includes a second transfer member for forming a second transfer portion that second-transfers the toner images first-transferred on the intermediate transfer belt onto a transfer material, wherein the transfer unit has a first transfer surface, at which the plurality of image forming units come into contact with the intermediate transfer belt, the first-transfer surface being arranged in an inclined manner such that a portion near the cleaning device is located at an upper side and a portion near the second transfer member is located at the lower side, and wherein the container is at least partly arranged in a space that is formed below the cleaning device and above an inclined side wall surface of the image forming unit nearest to the cleaning device.

15. The image forming apparatus according to claim 14, wherein a surface of the container facing the image forming unit arranged at the most upstream side is an inclined surface that is parallel to the inclined side wall surface of the image forming unit nearest to the cleaning device.

16. The image forming apparatus according to claim 15, wherein the discharge portion is provided above the inclined surface of the container.

17. The image forming apparatus according to claim 1, wherein the container is integrated into the second open-close member, the container being detachably mountable on the apparatus body together with the second open-close member.

18. An image forming apparatus comprising;

an apparatus body;

a photosensitive member that is rotatable, configured to bear a toner image;

a transfer unit including a belt that transports the toner image on the photosensitive member, and a cleaning device that removes a toner adhering to the belt, the transfer unit being detachably mountable on an apparatus body; and a container that houses the toner removed by the cleaning device, the container is detachably mountable on the apparatus body;

wherein, in a direction perpendicular to a rotational axis of the photosensitive member and with respect to the photosensitive member, the apparatus body includes a first open-close member in one side and a second open-close member in the other side, wherein the transfer unit is detachable with respect to the apparatus body through a space that is formed when opening the first open-close member with respect to the apparatus body, wherein the container is detachable with respect to the apparatus body through a space formed when opening the second open-close member with respect to the apparatus body, and wherein each of the transfer unit and the container are independently and respectively detachable with respect to the apparatus body, and mounting-detaching directions thereof are in opposite direction with each other.

19. The image forming apparatus according to claim 18, wherein a transport direction of the belt is a direction parallel to a moving direction of the belt in a region in which the belt faces the photosensitive member.

20. The image forming apparatus according to claim 19, wherein a discharge portion is provided, the discharge portion extending in the mounting-detaching direction of the container, for discharging the toner removed by the cleaning device to the container, the discharge portion is provided at the cleaning device, and has a shape protruding from the cleaning device to the container.

21. The image forming apparatus according to claim 20, wherein the transfer unit includes a plurality of support members that support the belt, and an urging member, one of the plurality of support members being a tension roller that is urged by the urging member for applying a tension to the belt, the cleaning device facing the tension roller through the belt, a protruding direction of the discharge portion being parallel to an urging direction of the urging member.

22. The image forming apparatus according to claim 20, wherein, when the container is detached from the apparatus body, the container is detached in a direction substantially horizontal to a protruding direction of the discharge portion.

23. The image forming apparatus according to claim 20, wherein the container has an inflow port into which the toner discharged from the discharge portion flows, and if the transfer unit is mounted on the apparatus body while the container is mounted on the apparatus body, the discharge portion is arranged inside the inflow port when the transfer unit is mounted.

* * * * *